US005857822A

United States Patent [19]

Christenson

[11] Patent Number: 5,857,822

[45] Date of Patent: Jan. 12, 1999

[54] EJECTION AND COMPACTING SYSTEM FOR REFUSE TRUCK

[75] Inventor: Ronald E. Christenson, Parsons, Tenn.

[73] Assignee: McNeilus Truck and Manufacturing, Inc., Dodge Center, Minn.

[21] Appl. No.: 829,652

[22] Filed: Mar. 31, 1997

[51] Int. Cl.[6] ..... B65F 3/28

[52] U.S. Cl. ..... 414/408; 414/517; 414/525.6; 414/518

[58] Field of Search ..... 414/406, 407, 414/408, 409, 510, 509, 511, 512, 513, 514, 515, 516, 517, 518, 525.6, 525.3, 501, 525.1, 502; 254/10 R, 122; 100/218, 214

[56] References Cited

U.S. PATENT DOCUMENTS

| | | | |
|---|---|---|---|
| 3,901,394 | 8/1975 | Bowles . | |
| 4,041,799 | 8/1977 | Teti | 414/517 X |
| 4,544,320 | 10/1985 | Haines | 414/517 X |
| 4,576,540 | 3/1986 | Derain et al. | 414/517 X |
| 4,627,783 | 12/1986 | DeFilippi | 414/517 |
| 4,715,767 | 12/1987 | Edelhoff et al. | 414/408 |
| 4,877,366 | 10/1989 | DeFilippi | 414/517 |
| 5,064,332 | 11/1991 | Edelhoff et al. | 414/517 X |

FOREIGN PATENT DOCUMENTS

| | | | |
|---|---|---|---|
| 1217728 | 3/1986 | U.S.S.R. | 414/517 |
| 1454889 | 11/1976 | United Kingdom | 414/517 |

*Primary Examiner*—Frank E. Werner
*Attorney, Agent, or Firm*—Haugen and Nikolai, P.A.

[57] ABSTRACT

A packing and ejecting system for a front or side loading refuse vehicle for packing refuse from a charging hopper into an associated storage body and fully ejecting the refuse from a rearward portion of the storage body without tilting the storage body. A loading device may be used to load refuse or recyclables from the front or side of the vehicle into the charging hopper. A packing and ejecting device may be mounted within the charging hopper without reducing the holding capacity of the charging hopper. The packing and ejecting device includes a substantially hollow cylinder carrier interconnecting crossed pairs of packing cylinders and ejecting cylinders, wherein the extension of the packing cylinders, with the ejecting cylinders retracted, linearly displaces the packer panel and cylinder carrier through a first longitudinal portion of the storage body and extension of both the ejecting cylinders and the packing cylinders, displaces the packer panel through the entirety of the storage body and where the fully retracted cylinders store within a hollow portion of the cylinder carrier.

7 Claims, 6 Drawing Sheets

EJECTION AND COMPACTING SYSTEM FOR REFUSE TRUCK

BACKGROUND OF THE INVENTION

I. Field of the Invention

The present invention relates generally to refuse vehicles, particularly any front or side loading, rear discharging vehicle body dedicated to hauling refuse and recyclables, and more specifically relates to a new compacting and ejecting mechanism disposed within such a vehicle for packing refuse or recyclables from a charging hopper into an associated oversized, relatively long, storage body and later fully ejecting the same from the storage body without tilting a portion of the storage body.

II. Related Art

Refuse hauling trucks commonly include a heavy-duty chassis and a hollow truck body mounted on the chassis and dedicated to receiving, compacting and discharging refuse materials. This combination generally includes all the associated hydraulic, pneumatic and/or electric operating mechanisms associated with heavy-duty packing and ejection equipment. Such trucks are typically loaded from the rear, front, or side and have heavy hydraulic-operated compacting systems to compact the refuse within the storage bodies of the trucks.

In the case of front or side loading vehicles, refuse or recyclables are dumped into a top loading charging hopper rearward of both the vehicle cab and a packing blade disposed in a retracted or stowed position within the charging hopper. In one type of cylinder-operated packing blade, a hollow, relatively vertical ram is moved aft along a horizontal plane in the manner of a plow blade to pack and compress the refuse a short distance into the storage body after each loading. Between loadings, the ram or packer blade is moved to a forward stowed position in the charging hopper, to allow more refuse to enter the charging hopper rearward of the blade. In this incremental manner, refuse is eventually packed against a heavy-duty tailgate until the storage body is full. Typically, the packed material in a full storage body is ejected or discharged by opening the heavy tailgate and tilting the storage body to dump the contents. Ejection may be assisted by employing the packing ram to push the material toward the open tailgate, but full powered ejection is not possible. Thus the load must not be packed so tight that gravity cannot cause the load to empty from the storage body. A representative example of such a refuse vehicle appears in U.S. Pat. No. 4,715,767, issued to Edelhoff et al. which describes a front loading refuse vehicle that must be tilted to empty the refuse from the storage compartment of the vehicle.

In the refuse hauling industry, the total load that a refuse vehicle is able to carry before requiring dumping, is becoming increasingly significant. The fewer times a refuse vehicle must be emptied at a waste site, the more efficient the refuse handling process becomes. It will be recognized that the available load capacity may be restricted by the particular type of packing or ejecting arrangement implemented in the refuse vehicle. While it is desirable to increase the capacity of the storage body the overall size of the vehicle cannot exceed certain size, weight and height restrictions.

U.S. Pat. No. 3,901,394 issued to Bowles discloses a compacting and ejecting system for a self-contained refuse handling and transporting vehicle. It does not appear that the Bowles' packing/ejecting system would be useful in an oversized storage body. In that system, a packing ram is positionable in either of a packing or ejecting position within the body of the vehicle. The packing ram includes a diagonally telescoping cylinder aligned vertically within the charging hopper opening, wherein one end is attached to the packing ram and the other end is attached to an anchor block. The anchor block is slidable along upper side rails between a first packing position and a second ejecting position and includes pins or plungers which lock into either fore (packing) or aft (ejecting) holes. When the pins are engaged in the holes, the anchor block is locked into position. A cylinder is used to withdraw and disengage the pins from the holes. To move the anchor block between fore and aft positions, an inch worm type motion is required, extending the packing cylinder, unlocking the anchor block and retracting the packing cylinder.

U.S. Pat. No. 4,877,366 issued to De Filippi discloses a packing and ejecting system operable in a conventional refuse vehicle. A packing ram and sliding block or bridge slide fore and aft within the charging hopper and storage body on a pair of tracks. The pair of tracks are spaced apart and positioned in the lower corners of the storage body, extending longitudinally therein. A telescopic ejecting cylinder is both centered between the side walls of the charging hopper and positioned between the forward end of the charging hopper and sliding block. Essentially horizontal, criss-crossed compacting cylinders are positioned between the sliding block and a packing ram. While this system can accomplish full ejection, it does so with the sacrifice of significant loading volume. As seen in FIGS. 1–2, when the compacting cylinders are fully retracted, the packing ram is drawn towards but short of the sliding block. In this arrangement, the load capacity of the charging hopper is reduced by the width of the sliding block and the distance between the sliding block and the packing ram when positioned in the stowed position.

While strides have been made, a need clearly persists for a packing apparatus that is both operable in a packing and fully ejecting mode that avoids potential jamming, and is operable in an oversized or elongate storage body without significantly decreasing the holding capacity of the charging hopper and which thereby allows refuse to be loaded from either the front or side while eliminating the need to tilt the storage body during the dump cycle. The present invention meets these needs.

SUMMARY OF THE INVENTION

The purpose of the present invention is to provide a combined packing and ejecting mechanism for a front or side loading refuse vehicle having rearward discharge that maximizes the holding capacity of the charging hopper and ejects a load from an oversized, relatively long, storage body. The packing and ejecting mechanism packs refuse from a charging hopper into an associated storage body and later fully ejects the refuse from the storage body. The packing and ejecting mechanism is generally disposed within the charging hopper of the vehicle and is operable between stowed, packing, and ejection positions. The packing and ejecting mechanism generally includes a packer ram or panel and an intermediate cylinder carrier that combines and coordinates the packing and ejection positions of the packer panel in conjunction with a pair of packing cylinders and a pair of telescoping ejection cylinders. In the preferred embodiment, both pairs of cylinders are mounted in an X or crossing pattern and operate in an essentially horizontal plane. When the packing and ejecting mechanism is in the fully retracted or stowed position, each pair of packing cylinders and each pair of ejecting cylinders are folded or collapsed in scissors fashion and tucked within hollow portions of the cylinder carrier which, in turn, is itself tucked under the packer panel to thereby reduce the amount of space in the forward end of the charging hopper required to stow the packer panel and operating system. During each compaction cycle, the cylinder carrier remains tucked under the packer panel with the ejection cylinders collapsed.

The packer panel is positioned within the charging hopper and linearly displaceable rearward between stowed, packing and ejecting positions for respectively charging materials into the charging hopper, packing materials into the storage body and ejecting the materials from the storage body. The packer panel and cylinder carrier slide along a track or guide system of known construction, wherein the packer panel includes a pair of ejecting cylinders pivotally attached thereto. The other end of each ejecting cylinder is pivotally attached to the cylinder carrier. A follower panel is guided horizontally in the charging hopper and connected to the packer panel, thereby allowing loading of refuse or recyclables into the charging hopper when the packer panel is displaced rearward during a packing cycle, without exposing the pairs of packing and ejecting cylinders or the area forward of the packer panel to falling and system clogging refuse.

The pair of packing cylinders and the pair of telescoping ejecting cylinders are attached to the cylinder carrier and retract into hollow sections of the cylinder carrier. The telescoping ejection cylinders each have a first end pivotally attached to the cylinder carrier and a second end pivotally attached to an opposite side of the packer panel. The double acting compaction cylinders have a first end pivotally attached to a bracket in the forward end of the charging hopper and a second end rotatably attached to an opposite side of the cylinder carrier within a second hollow portion. The pivot joints may be conventional or maintenance free greaseless connections as shown in co-pending U.S. patent application Ser. No. 08/752,220 filed Nov. 19, 1996 and assigned to the same assignees as the present invention, the entire disclosure of which is incorporated herein by reference.

In operation, at the beginning of a cycle, the packer panel is usually positioned in its fully forward stowed position within a forward portion of the charging hopper, such that refuse may be loaded into the charging hopper above and rearward of the packer panel. Both the packing cylinders and the ejecting cylinders are retracted (collapsed) when the packer panel is in the stowed position. Periodically, the packing cylinders are extended, thereby linearly displacing the packer panel and cylinder carrier rearward through a first longitudinal portion or distance along the storage body, pushing the charged refuse ahead of the panel into the storage body. The packing cylinders are then retracted to return the packer panel to its stowed position. During the packing cycle, the ejecting cylinders remain in their collapsed or retracted position folded within the hollow portion of the cylinder carrier and tucked under the packing ram.

In the eject mode, the tailgate is opened and the packer panel is linearly displaced through a first longitudinal portion of the storage body by extending the packing cylinders. Then, the ejecting cylinders are extended, unfolding and elongating the telescoping cylinder, thereby further linearly displacing the packer panel rearward through the remainder of the storage body and thus forcing all of the refuse out the rearward opening ahead of the packer panel without the need to tilt the storage body.

OBJECTS

It is accordingly a principal object of the present invention to provide a compacting and ejecting system that is operable for both packing refuse into an oversized (relatively long) storage body and later ejecting the refuse from the oversized storage body.

Another object of the present invention is to provide a push-out ejection system for refuse trucks having an oversized storage body that is operable as both a packer and an ejector without compromising the holding capacity of the charging hopper.

These and other objects, as well as these and other features and advantages of the present invention will become readily apparent to those skilled in the art from a review of the following detailed description of the detailed embodiments in conjunction with the accompanying claims and drawings in which like numerals in the several views refer to corresponding parts.

DETAILED DESCRIPTION

The present invention represents an improvement to the packing and ejecting mechanism of refuse trucks that may reduce associated pickup, delivery, and maintenance costs. The present invention is directed to a mechanism that is operable both as a packer panel and as an ejector panel within the refuse vehicle.

Figure 1:
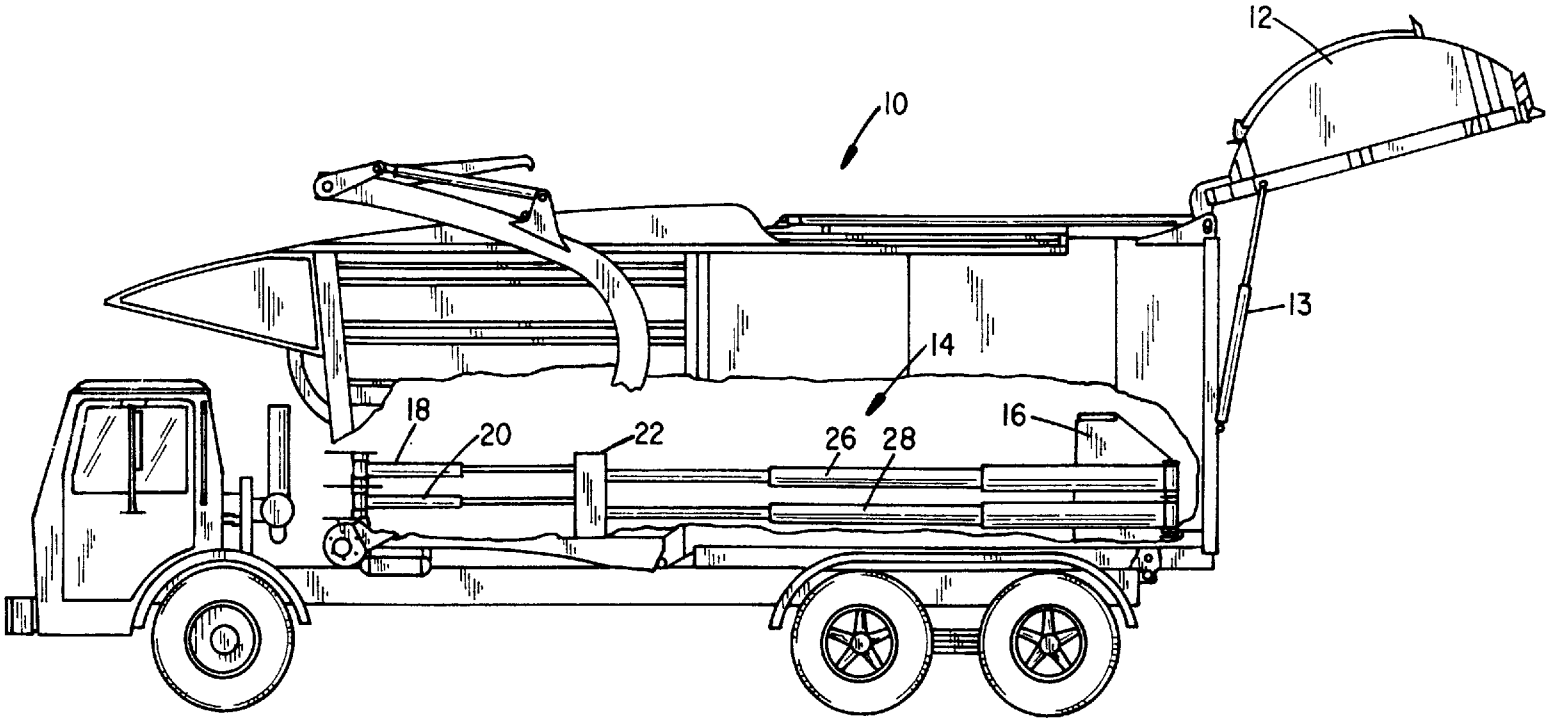
FIG. 1 is a side elevational view of a front loading refuse vehicle having a portion of the charging hopper and storage body with a portion broken away, to thereby expose the packing and ejecting system with the packer panel shown in its fully extended, ejecting position, with the follower panel removed.
Figure 2:
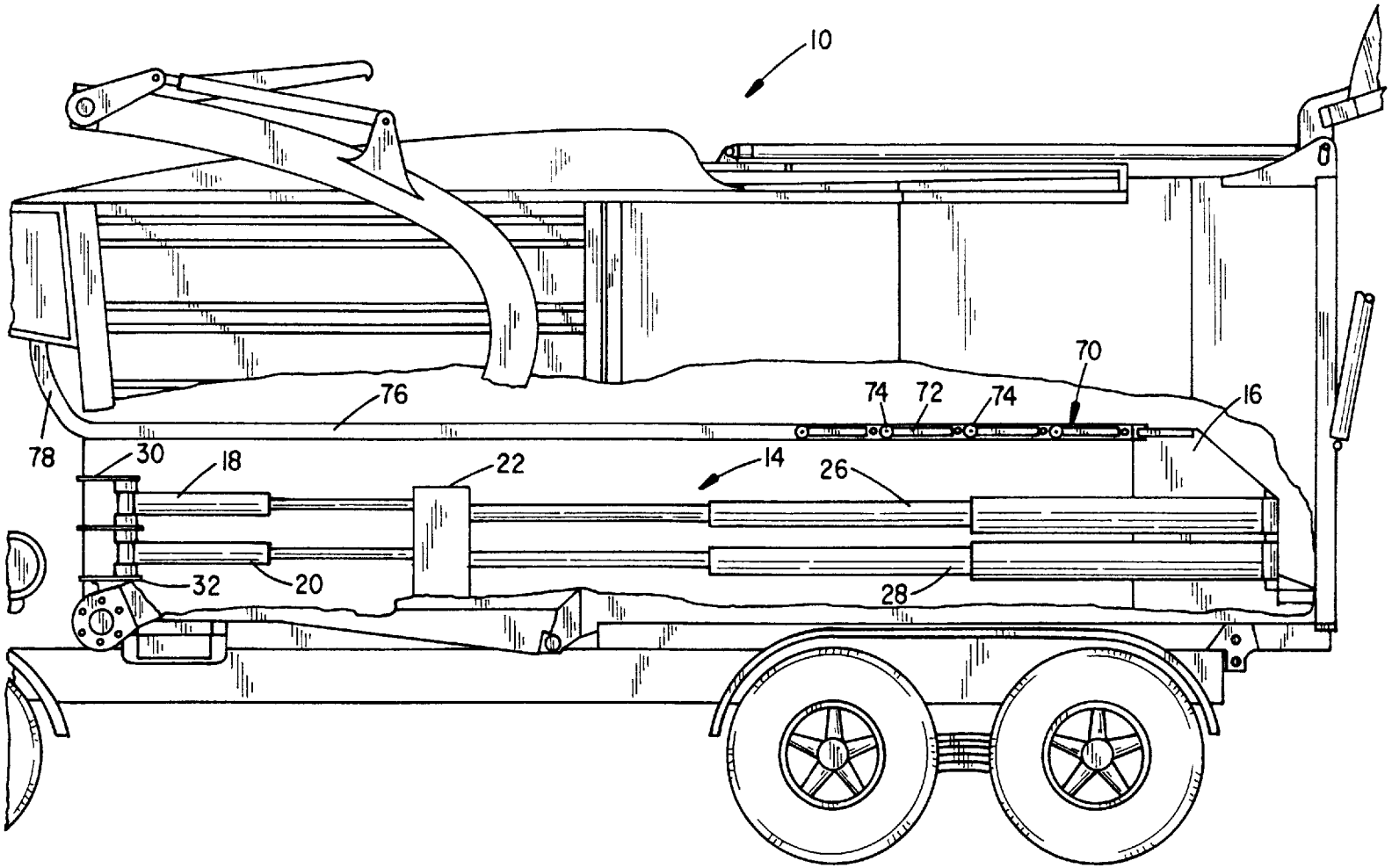
FIG. 2 is an enlarged fragmentary partial sectional side elevational view of a charging hopper and storage body of the type shown in FIG. 1 showing a follower panel attached to the packer panel.

As depicted in FIGS. 1 and 2, a refuse vehicle 10 of the front loading variety is shown with the tailgate 12 in the fully open (raised) position with cylinders as at 13 extended and the packing and ejecting mechanism 14 in the fully extended ejecting position. The packing and ejecting mechanism 14 generally includes a packer panel 16, a pair of packing cylinders 18 and 20, a divided cylinder carrier 22, a pair of ejecting cylinders 26 and 28, and a pair of base members or brackets 30 and 32. The packer panel 16 and cylinder carrier 22 may slide along either outer track 80 or central track 82. Those skilled in the art will appreciate that wear shoes may be provided, wherein the shoes for the packer panel 16 and cylinder carrier 22 may be constructed incorporating the novel features described in co-pending U.S. Pat. applications Ser. No. 08/717,485 filed Sep. 20, 1996, now abandoned Ser. No. 08/790,004 filed Jan. 28, 1997 and Ser. No. 08/792,880 filed Jan. 31, 1997 all of which are assigned to the same assignees as the present invention, the entire disclosure all being deemed incorporated herein by reference.

Those skilled in the art will appreciate that a multi-segmented, jointed follower panel 70 may be attached to the packer panel 16, thereby allowing refuse to be loaded in the charging hopper even when the packer panel 16 is linearly displaced rearward during the packing mode. FIG. 2 shows the position of the follower panel 70 during an ejecting mode. One follower panel design is described in co-pending U.S. patent application Ser. No. 08/748,649 filed Nov. 14, 1996 and assigned to the same assignees as the present invention, the entire disclosure of which is incorporated herein by reference. In FIG. 2, the follower panel 70, which is attached at one end to the packer panel and has a free trailing end, generally comprises several panel segments 72 consecutively hinged together, supporting rollers 74 are attached to each end of each panel 72, and adapted to ride in a track or guide as at 76 attached to each of the sidewalls of the storage body 36 and charging hopper 34. As the packer panel 16 is displaced rearward, the follower panel 70 is pulled behind the packer panel. As the packer panel 16 is retracted to the stowed position, the follower panel 70 is pushed along the track 76 forward of the packer panel 16 partially extending into a curved storage portion of the guide at 78.

Figure 3:
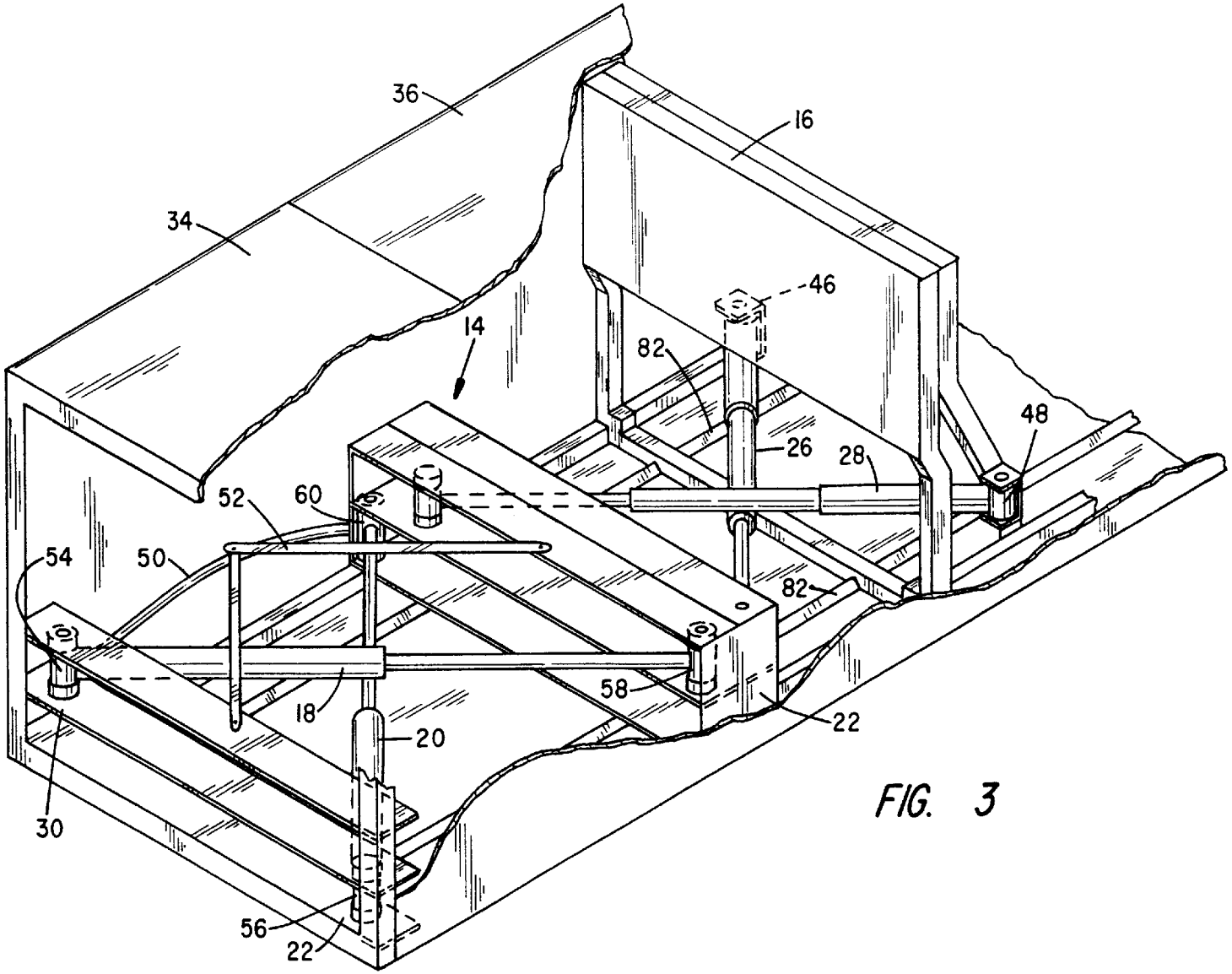
FIG. 3 is an enlarged fragmentary partial sectional perspective view of an alternate charging hopper and storage body with the compacting and ejecting cylinders fully extended for clarity.
Figure 4:
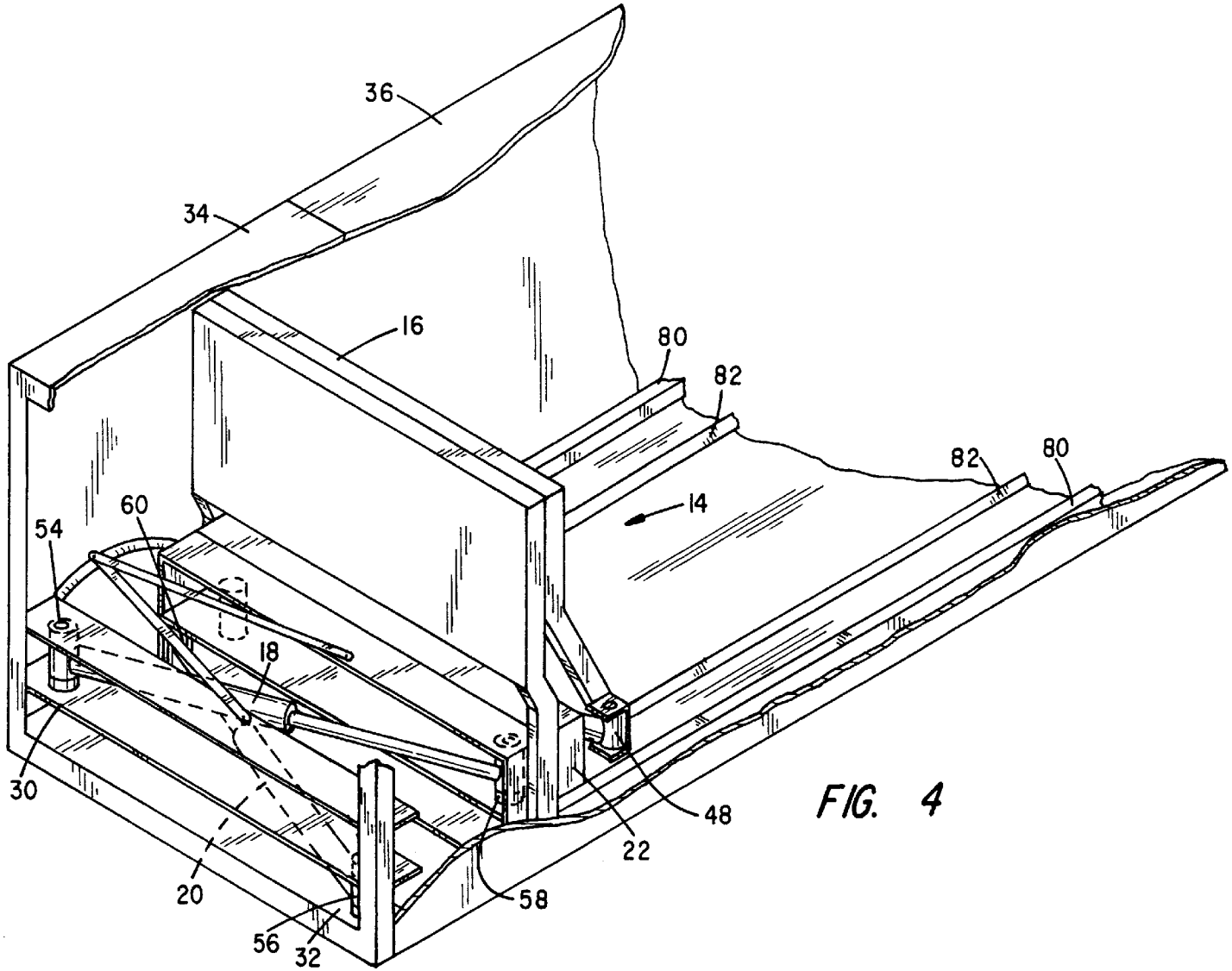
FIG. 4 is an enlarged fragmentary partial sectional perspective view of the charging hopper and storage body of the type shown in FIG. 3 with the ejecting cylinders retracted.

FIG. 3 shows the alignment and positioning of a packing and ejecting mechanism 14 disposed in a refuse vehicle in a fully extended ejecting position. FIG. 4 shows the alignment and positioning of the cylinder carrier 22 and ejecting cylinders during a compaction cycle. The packing cylinders 18–20 are of a double acting fluid operated type and the ejecting cylinders 26–28 are of a double acting telescopic fluid operated type of suitable known construction available from various manufacturers, the attachment of which is further described below. Each base member 30 and 32 is a heavy metal plate section shown attached to a forward corner portion of the charging hopper 34.

Figure 5:
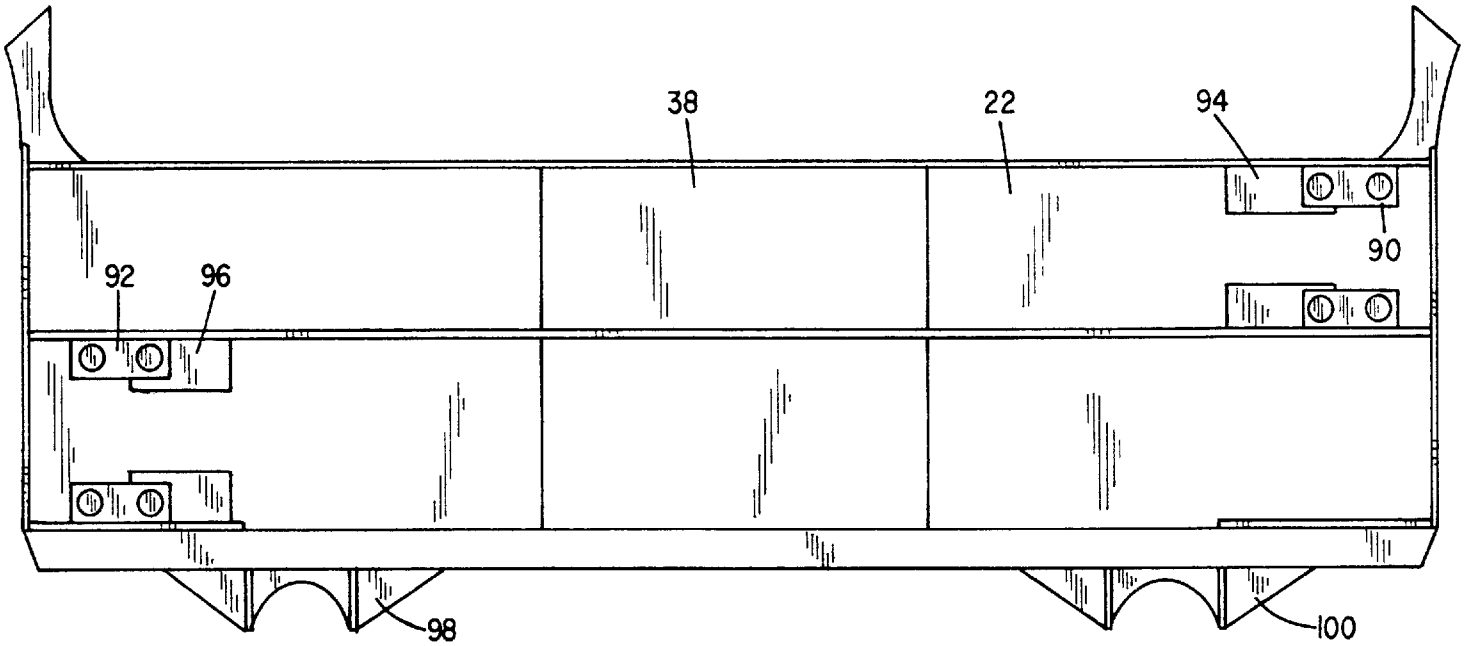
FIG. 5 is a front elevational view of the a cylinder carrier.
Figure 6:
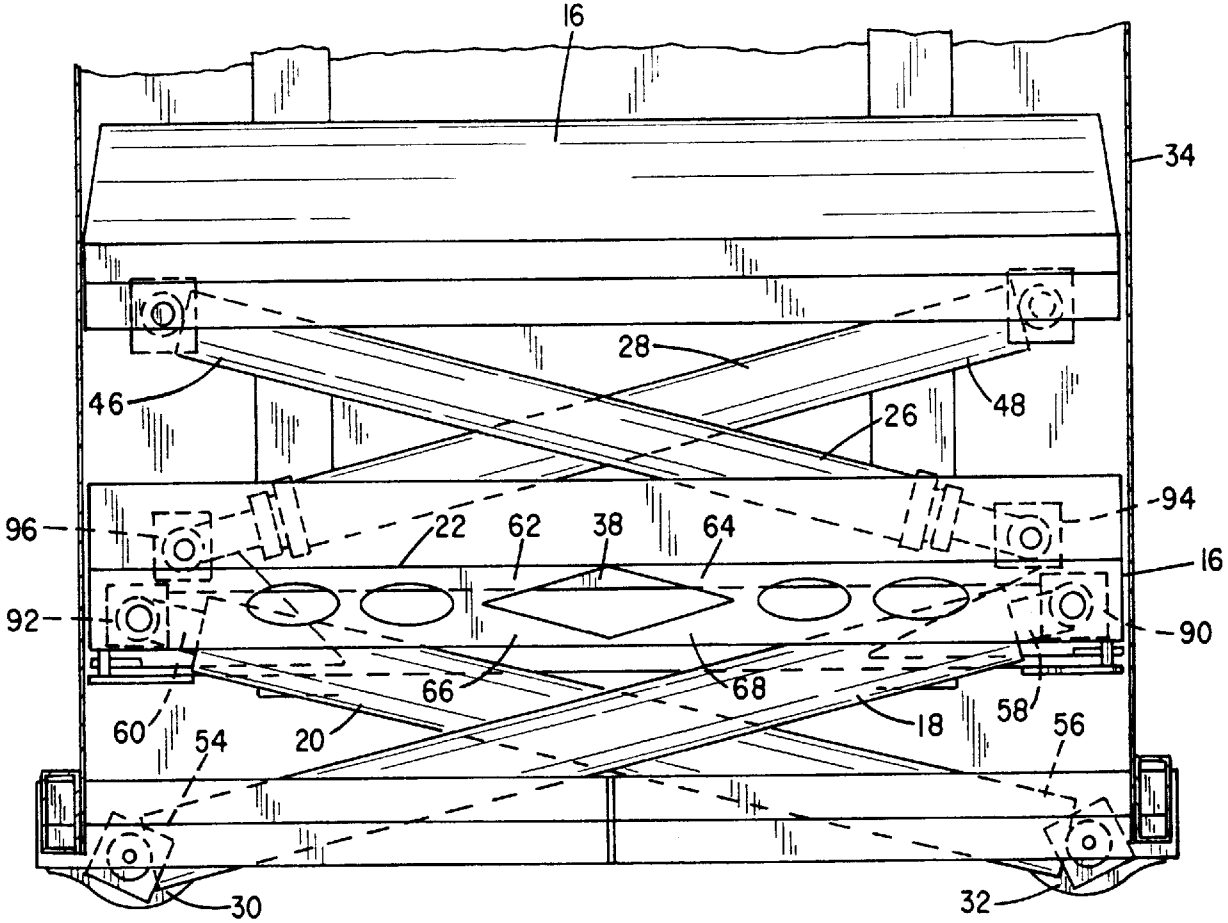
FIG. 6 is a fragmentary partial sectional top plan view of the charging hopper, packing ram, cylinder carrier and associated cylinders.

The cylinder carrier 22 is essentially hollow having wear shoes 98–100 attached to a bottom portion thereof. A spacer member 38 essentially divides the hollow cylinder carrier 22 into four regions 62–68. Packing cylinder 18 is pivotally mounted to cylinder mount 90 attached within carrier 22 and extends through region 68. Packing cylinder 20 is pivotally mounted to cylinder mount 92 attached within carrier 22 and extends through region 66. The rod end of ejecting cylinder 26 is pivotally mounted to cylinder mount 94 attached within carrier 22 and extends through region 64. The rod end of ejecting cylinder 28 is pivotally mounted to cylinder mount 96 attached within carrier 22 and extends through region 62. Ports for the telescopic double acting ejecting cylinders 26 and 28 are in the rod end of the ejecting cylinders and are of known suitable construction. Cylinder bodies 46 and 48 of ejecting cylinders 26 and 28 are pivotally attached to opposite sides of the packer panel 16. Cylinder ends 54 and 56 of respective packing cylinders 18 and 20 are pivotally attached to the respective base members 30 and 32. Rod ends 58 and 60 of packing cylinders 18 and 20 are pivotally attached inside the cylinder carrier 22 to cylinder mounts as described above. (see FIGS. 5 and 6).

The cylinders of each pair of packing and ejecting cylinders 18–20 and 26–28 are positioned in vertically offset horizontal planes, such that in the stowed position each pair of cylinders fold in a vertical arrangement above and below each other (see FIGS. 3 and 4). In the stowed position, the longitudinal axis of the packing cylinders 18 and 20, the ejecting cylinders 26 and 28, and the cylinder carrier 22 are all aligned within a forward end of the charging hopper 34 in a disposition relatively transverse to the longitudinal axis of the storage body 36.

The displacement of the packing and ejecting mechanism will be described in further detail. In the stowed position both the packing cylinders 18 and 20 and the ejecting cylinders 26 and 28 are in the retracted position. The crisscrossing of each pair of cylinders allows the cylinders to be positioned substantially laterally within the charging hopper 34 when in the stowed position, thereby reducing the amount of space required within the charging hopper 34 for stowage of the packing and ejecting mechanism 14. The ejecting cylinders 26 and 28 are tucked under the packing ram 16 when in the retracted or stowed position.

When the packing cylinders 18 and 20 are extended, the cylinder carrier 22 and packer panel 16 together are linearly displaced rearward a short distance, typically about 2 feet, into the storage body 36 of the refuse vehicle. As the ejecting cylinders 26 and 28 extend, the cylinder carrier 22 remains fixed relative to the charging hopper and the packer panel 16 continues to slide rearward, thereby further linearly displacing the packer panel 16 toward the rear of the storage body 36. When the telescoping ejecting cylinders 26 and 28 are fully extended, the packer panel 16 is displaced fully to the rear of the storage body 36 (see FIGS. 1 and 2). In order to return the packer panel 16 to the stowed position, the ejecting cylinders 26 and 28 and packing cylinders 18 and 20 are retracted.

In order to provide hydraulic power to the double acting telescopic ejection cylinders 26–28, hydraulic supply and return lines 50 of known suitable construction are provided. Lines 50 are flexible and may be supported by a multiple hinged scissors like support 52 which elevates the lines 50 above the packing cylinders 18–20 (see FIG. 3). In this way, as the cylinder carrier 22 and packer 16 move fore and aft, the lines 50 remain above and out of engagement with the cylinders 18–20.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A combined, packing and ejecting mechanism for a front or side loading, rear discharging, refuse vehicle for packing refuse from a charging hopper into an associated storage body and later ejecting the refuse from the storage body, wherein a loading device loads the refuse into the charging hopper, said packing and ejecting mechanism comprising:

(a) a packer panel having a packing blade and a packer panel recess behind the packing blade positioned within the charging hopper and linearly displaceable along in said refuse vehicle among stowed, packing, and ejecting positions for respectively, receiving charged materials, packing materials into the storage body and ejecting packed materials from the storage body;

(b) a cylinder carrier having hollow portions, wherein the cylinder carrier is adapted for storage within a recess of the packer panel when in the stowed position;

(c) a pair of ejecting cylinders for use in ejecting refuse from the vehicle, each having a first end pivotally attached within the hollow portion of the cylinder carrier and a second end pivotally attached to the packer panel, said ejecting cylinders adapted to nest within a hollow portion of the cylinder carrier when retracted;

(d) a pair of packing cylinders for linearly displacing the packer panel between a stowed and packing position, each having a first end pivotally attached to a base member attached to the forward end of the charging hopper and a second end pivotally attached within the hollow portion of the cylinder carrier, said packing cylinders adapted to nest within a hollow portion of the cylinder carrier when retracted;

(e) wherein extension of the packing cylinders, with the ejecting cylinders retracted, linearly displaces the packer panel through a first longitudinal portion of the storage body and extension of the ejecting cylinders together with extension of the packing cylinders displaces the packer panel through the remainder of the storage body; and (f) wherein upon full retraction, all cylinders nest entirely within said packer panel recess such that the packer panel in a fully retracted position fits cleanly against a vertical hopper wall.

2. The refuse vehicle as recited in claim 1, further including a telescoping follower panel attached to a top portion of said packer panel.

3. The packing and ejecting mechanism as recited in claim 1, wherein the packing cylinders and the ejecting cylinders are vertically offset and fold together when said packing cylinders and said ejecting cylinders are retracted to form collapsed X patterns when in the stowed position.

4. The refuse vehicle as recited in claim 1 wherein each of said base members is positioned in the charging hopper proximate a forward corner thereof.

5. A combined, packing and ejecting mechanism for a front or side loading, rear discharging, refuse vehicle for packing refuse from a charging hopper into an associated storage body and later ejecting the refuse from the storage body, wherein a loading device loads the refuse into the charging hopper, said packing and ejecting mechanism comprising:

(a) a packer panel having a packing blade and a packer panel recess behind the packing blade positioned within the charging hopper and linearly displaceable along in said refuse vehicle among stowed, packing, and ejecting positions for respectively, receiving charged materials, packing materials into the storage body and ejecting packed materials from the storage body;

(b) a cylinder carrier having hollow portions, wherein the cylinder carrier is adapted for storage within a recess of the packer panel when in the stowed position;

(c) a pair of ejecting cylinders for use in ejecting refuse from the vehicle, each having a first end pivotally attached within the hollow portion of the cylinder carrier and a second end pivotally attached to the packer panel, said ejecting cylinders adapted to nest within a hollow portion of the cylinder carrier when retracted;

(d) a pair of packing cylinders for linearly displacing the packer panel between a stowed and packing position, each having a first end pivotally attached to a base member attached to the forward end of the charging hopper and a second end pivotally attached within the hollow portion of the cylinder carrier, said packing cylinders adapted to nest within a hollow portion of the cylinder carrier when retracted;

(e) a telescoping follower panel attached to a top portion of said packer panel;

(f) wherein extension of the packing cylinders, with the ejecting cylinders retracted, linearly displaces the packer panel through a first longitudinal portion of the storage body and extension of the ejecting cylinders together with extension of the packing cylinders displaces the packer panel through the remainder of the storage body; and (g) wherein upon full retraction, all cylinders nest entirely within said packer panel recess such that the packer panel in a fully retracted position fits cleanly against a vertical hopper wall.

6. The refuse vehicle as recited in claim 5, wherein the base members are positioned in the charging hopper proximate a forward corner of the charging hopper.

7. The packing and ejecting mechanism as recited in claim 5, wherein the packing cylinders and the ejecting cylinders are vertically offset and fold together when said packing cylinders and said ejecting cylinders are retracted to form collapsed X patterns when in the stowed position.

* * * * *